US010927670B2

(12) United States Patent
Ludwig

(10) Patent No.: US 10,927,670 B2
(45) Date of Patent: Feb. 23, 2021

(54) LOGGING WHILE RUNNING CASING

(71) Applicant: HALLIBURTON ENERGY SERVICES, INC., Houston, TX (US)

(72) Inventor: Wesley Neil Ludwig, Fort Worth, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 102 days.

(21) Appl. No.: 16/435,199

(22) Filed: Jun. 7, 2019

(65) Prior Publication Data

US 2020/0003051 A1 Jan. 2, 2020

Related U.S. Application Data

(60) Provisional application No. 62/691,482, filed on Jun. 28, 2018.

(51) Int. Cl.

| | |
|---|---|
| ***E21B 49/00*** | (2006.01) |
| ***E21B 47/01*** | (2012.01) |
| ***E21B 47/017*** | (2012.01) |
| ***E21B 23/14*** | (2006.01) |
| ***E21B 34/06*** | (2006.01) |
| ***E21B 47/10*** | (2012.01) |
| *E21B 33/14* | (2006.01) |

(52) U.S. Cl.

CPC ..... *E21B 49/00* (2013.01); *E21B 23/14* (2013.01); *E21B 34/06* (2013.01); *E21B 47/017* (2020.05); *E21B 47/101* (2013.01); *E21B 33/14* (2013.01)

(58) Field of Classification Search

CPC ..... E21B 49/00; E21B 47/017; E21B 23/14; E21B 34/06; E21B 33/14; E21B 21/10; E21B 43/10; E21B 7/01

See application file for complete search history.

(56) References Cited

U.S. PATENT DOCUMENTS 4,664,189 A * 5/1987 Wittrisch ..... E21B 23/14 166/250.17
4,715,446 A * 12/1987 Wittrisch ..... E21B 23/14 166/381
4,799,546 A 1/1989 Hensley et al.
5,217,075 A * 6/1993 Wittrisch ..... E21B 36/003 166/302
5,433,276 A * 7/1995 Martain ..... E21B 23/006 166/384
6,119,777 A * 9/2000 Runia ..... E21B 47/017 166/254.2
6,419,013 B1 * 7/2002 Milne ..... E21B 23/08 166/250.17

(Continued)

*Primary Examiner* — Michael R Wills, III
(74) *Attorney, Agent, or Firm* — Polsinelli PC

(57) ABSTRACT

A system including a casing string having one or more casing segments, a logging tool, and one or more float valves. The casing string can have a distal end and a proximal end with the logging tool detachably coupled with the distal end thereof. The one or more float valves can be coupled with a distal end of the logging tool. The logging tool can have a battery power source transitionable between a standby power mode and a full power mode. The casing string is operable to be disposed in a wellbore and transition the logging tool from the standby power mode to the full power mode upon placement within a predetermined portion of the wellbore.

17 Claims, 4 Drawing Sheets

(56) References Cited

U.S. PATENT DOCUMENTS

| | | | | |
|---|---|---|---|---|
| 7,215,125 | B2 * | 5/2007 | Clark | E21B 47/01 324/368 |
| 7,407,006 | B2 | 8/2008 | Wilson et al. | |
| 7,537,061 | B2 | 5/2009 | Hall et al. | |
| 2011/0172922 | A1 | 7/2011 | Evans et al. | |
| 2012/0241172 | A1 * | 9/2012 | Ludwig | E21B 47/017 166/382 |

* cited by examiner

LOGGING WHILE RUNNING CASING

CROSS-REFERENCE TO RELATED APPLICATIONS

This application claims the benefit of U.S. Provisional Application No. 62/691,482, filed Jun. 28, 2018, the content of which is incorporated by reference herein in its entirety.

FIELD

The present technology is directed to a system and method for logging a wellbore within a subterranean formation. In particular, the present technology involves a system and method for logging a wellbore while running casing into the wellbore.

BACKGROUND

Drilling operations are often undertaken in unconventional reservoirs in an effort to extract more hydrocarbons from subterranean formations. Many wellbores are drilled horizontally through shale formations, then cased, perforated, fractured and ultimately placed in production. Often, a horizontal section of the wellbore traverses the "pay zone" and therefore may be required to be logged to determine such things as perforation placement. However, logging the wellbore adds cost at least in part through the added rig time required for the logging procedure. Therefore, it is advantageous to reduce or eliminate rig time associated with logging a wellbore after it has been drilled, but before casing is run into the wellbore.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
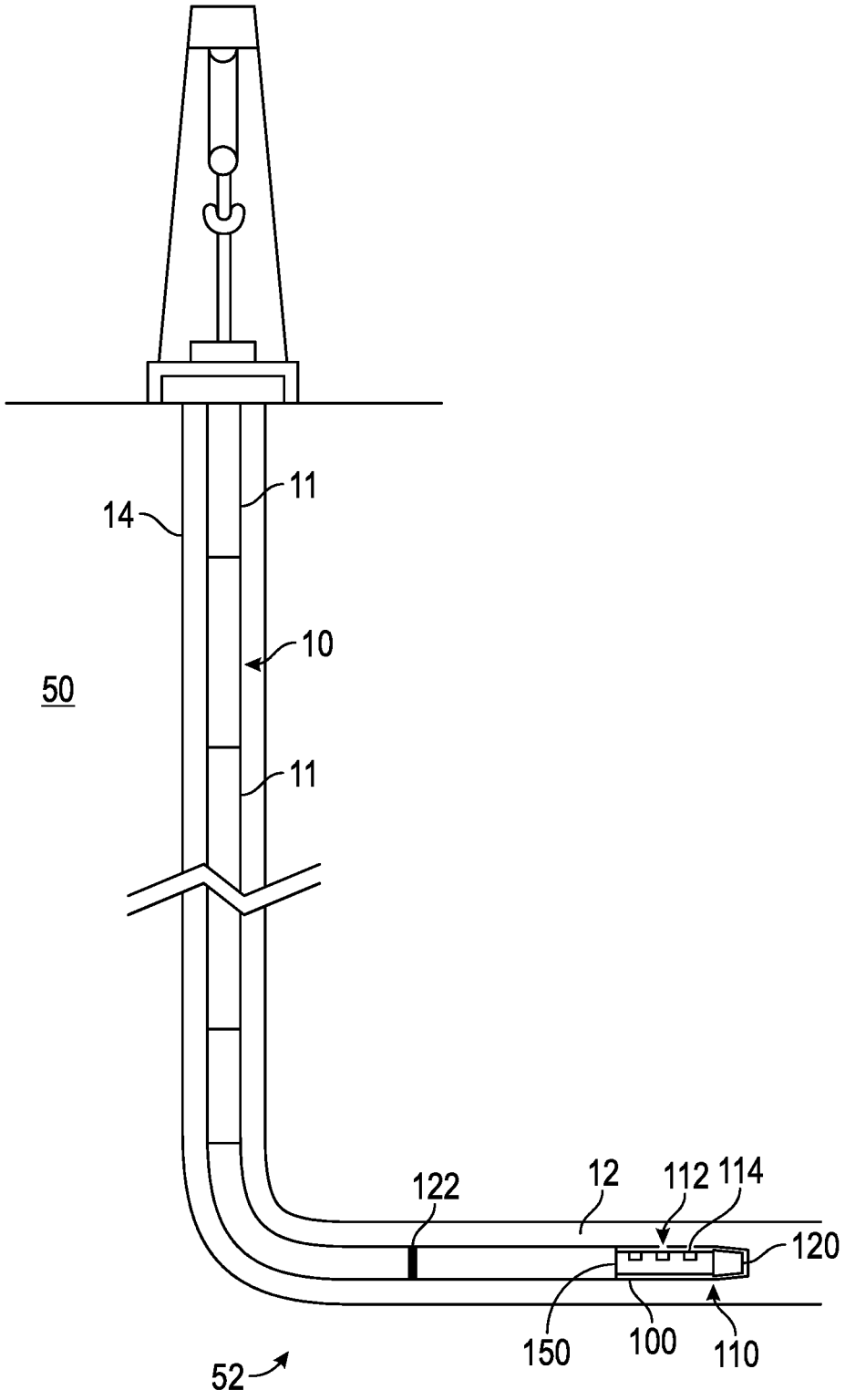
FIG. 1 is a schematic diagram of an example logging while casing procedure in accordance with various aspects of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

The present disclosure describes a new method for more efficiently conveying one or more logging tools into a wellbore by reducing the necessary rig time for conducting a logging procedure. A large part of the cost of a logging run is the associated rig time. The method and apparatus of the present disclosure reduces the amount of rig time required to perform a logging procedure by releasably fixing a logging tool at the bottom, distal end of a casing string which are then run together into the wellbore.

The logging tool can be battery operated to collect data over at least a portion of the time that the casing is being run into the well. After the logging tool has been conveyed through the desired formation interval, the tool is retrieved, for example, by attachment to a deployed wireline that releasably engages the logging tool. In addition to wireline, slickline and the like, tubular conveyances such as coiled tubing, joint tubing, or other tubulars can also be employed to retrieve the logging tool. To affect retrieval, the logging tool is decoupled from the casing and then pulled from the well. The present disclosure provides a system and method to reduce the rig time conventionally required in logging a wellbore because the only added rig time is that associated with the pulling process of the logging tool after executing the logging process simultaneously with deployment of the casing into the wellbore. As the logging data is acquired as the casing is tripped into the wellbore, no additional rig time is spent acquiring the logging data. This reduction in required rig time and the associated cost savings compared to conventional logging methods make logging more economical and therefore can advantageously increase its use.

The present disclosure includes a connection device operable to releasably couple a logging tool to the bottom end of a casing string. The connecting device can take the form of a releasable latch that allows the logging tool to be detached from the casing pipe and removed from the wellbore. The logging tool can be coupled to a lowest, distal most casing element (pipe joint) of a casing string at the surface before the casing string is run in hole. The distal most casing element will be the first casing element of the casing string that is run in hole. Following completion of the logging run and/or having logged a desired section of the wellbore, the logging tool can be released from the casing string and retrieved via wireline, coiled tubing, and/or similar conveyance without having to pull the casing string itself from the wellbore.

The logging tool can be battery operated, and in at least one instance of the present disclosure, activation of the logging tool is triggered when the logging tool reaches a zone of interest, to be logged, along the wellbore. Delayed activation, or awakening the logging tool when needed conserves battery life and/or memory space for collected data. Sensors can be included to determine the tool's location within a wellbore, and/or when the tool has traversed the zone of interest. The sensors can include pressure sensors, temperature sensors, accelerometers, inclinometers, casing collar locators (CCL), metal sensing devices and/or clocks. Instead of being completely "off" in a first stage of deployment into the wellbore, the logging tool can be operating in a low power mode (for example, a "standby mode") that reduces power consumption while periodically checking the readings from one or more of the sensors. When one or more sensor reading is consistent with reaching an interval of interest, for example, the logging tool can be powered up and logging data sensed and stored in memory.

In at least one instance, the memory can take the form of any known storage medium including, but not limited to hard disk drives (HDDs), solid state drives (SSDs), flash memory, random access memory (RAM) and the like, and any combinations thereof.

When the logging tool is near or at the end of the well, deployment of the casing string into the wellbore can be paused while a retrieval tool is deployed, for example on a wireline, to retrieve the logging tool from the well. The retrieval process can include conveying the retrieval tool down the casing string to the top of the logging tool, for instance, by using a pump down conveyance. Conveying the retrieval tool to the logging tool can also be accomplished by other suitable means such as wireline tractor and/or coiled tubing. A through port in the logging tool can be included to facilitate pumping down the retrieval tool to the logging tool.

The retrieval tool can be configured to latch to the logging tool upon contact and an electrical connection can also be made with the logging tool to provide power or communicate stored data. The connection device between the logging tool and the casing can include a release mechanism actuable by the retrieval tool to disconnect the logging tool from the casing. Advantageously, the connection device can include a latch that is configured to release the logging tool from the casing when the connected retrieval tool is pulled with a relatively small force, for example less than 2,000 pounds. Conversely, the connection device is configured to resist substantially larger compression forces on the logging tool, as much as 20,000 pounds for example, which could possibly occur should the logging tool strike the bottom end of the wellbore.

After the logging tool is unlatched/decoupled from the casing string, the logging tool can be returned to the surface and the casing run can be completed. The data stored by the logging tool can be downloaded via wired and/or wireless connection to an electronic device for analysis regarding the wellbore and surrounding formation. In at least one instance, the retrieval tool includes electrical connections operable to download and/or communicate data stored by the logging tool from within the wellbore.

In at least one instance, one or more float valves can be desired to be installed at or near the bottom (distal end) of the casing string to facilitate cementing the casing in place after the logging tool is retrieved. The float valve is generally a check valve that permits fluid to flow out of the casing string, including cement, but resists or prevents the inflow of fluids into the casing when installed and operational. A separate trip into the wellbore to set such a float valve after the logging tool's retrieval is undesirable, so in at least one configuration the float valve is releasably coupled proximate the bottom, distal end of the logging tool. Installation of the float valve in the casing string is accomplished as the logging tool is being retrieved up the casing string and the float valve encounters and matingly engages with a receiving profile in the casing string where the then installed float valve is retained.

Advantageously, the present disclosure permits larger diameter logging tools to be deployed using the casing string as compared to tools conveyed through a drill string because casing pipe typically has a larger inner diameter than drill pipe, which can also include restrictions created by tools required in the drilling process. To facilitate retrieval of the logging tool through the casing string, the tool need only have an outer diameter that is about a half an inch (about 1.25 cm) smaller than the inner diameter of the casing string. Further, the present disclosure reduces required rig time associated with well logging since the logging tool is deployed with the casing, not requiring its own installation trip. The present disclosure also permits the casing run to start immediately after the well is drilled, not having to wait for the logging process to be first conducted, as according to this disclosure, the logging trip is conducted simultaneously with the casing string being run into the hole.

In the disclosed configuration, at least a portion of the logging tool extends beyond the bottom of the casing string and is at risk of striking the borehole or other obstacles encountered as the casing string is lowered into the wellbore. For these reasons, in some instances, it is advantageous to provide a protective shield or sheath about at least part of the extended portion of the logging tool outside the casing string. Such a shield can be coupled to the distal most casing element of the casing string or to the logging tool itself. The protective shield can include one or more ports, apertures, and/or windows to enable sensor and logging operation therethrough. In at least some instances, the protective shield can be formed from composites and/or non-metal material to prevent interference with sensors and logging tools.

The protective shield can be threadingly engaged to the bottom of the casing string and shroud the logging tool therein. The shield is constructed to endure applied forces thereupon of approximately 20,000 pounds, and more, and to have the capacity to transfer those forces as compressive loads onto the casing string, without damage to the logging tool. In some instances, the protective shield can be ten foot long and be coupled to the distal end of the casing string. In at least one instance, the protective shield is not retrieved from the borehole, but is left downhole, attached to the casing string.

FIG. 1 illustrates a logging while casing process according to the present disclosure. One or more logging tools 100 can be coupled with the distal end 12 of a casing string 10 via a connection device 150. The casing string 10 can be formed from one or more casing segments 11 (may also be referred to as joints) coupled together. The casing segments 11 may be any tubular structure. The casing string 10 can be run into a wellbore 14 formed in a subterranean formation 50. The wellbore 14 can have one or more vertical and/or horizontal portions through which the casing string 10 can extend.

The connection device 150 releasably coupling the logging tool 100 with the distal end 12 of the casing string 10 advantageously comprises an actuable latching mechanism, but can also take the form of shear pins or any other detachable coupling system. In at least one instance, the connection device 150 is configured to withstand compressive loads of at least 20,000 pounds. Such compressive loads can result from engagement of the logging tool with one or more elements within the wellbore 14 including, but not limited to solid, liquid, and/or gas impingement, and/or impact with the wellbore 14, itself.

When the logging tool 100, disposed at the distal end 12 of the casing string 10 reaches a predetermined portion 52 of the subterranean formation 50, the logging tool 100 can switch from a low power, standby, mode to a full power, on, mode. The logging tool 100 can perform a logging operation as the casing string 10 is continued to be run in hole. After the logging tool 100 has passed through the predetermined portion 52 of the subterranean formation, or upon completion of the casing run, the logging tool 100 can return to a lower power, standby mode, and/or be retrieved and returned to surface via wireline and/or other conveyance.

Figure 2:
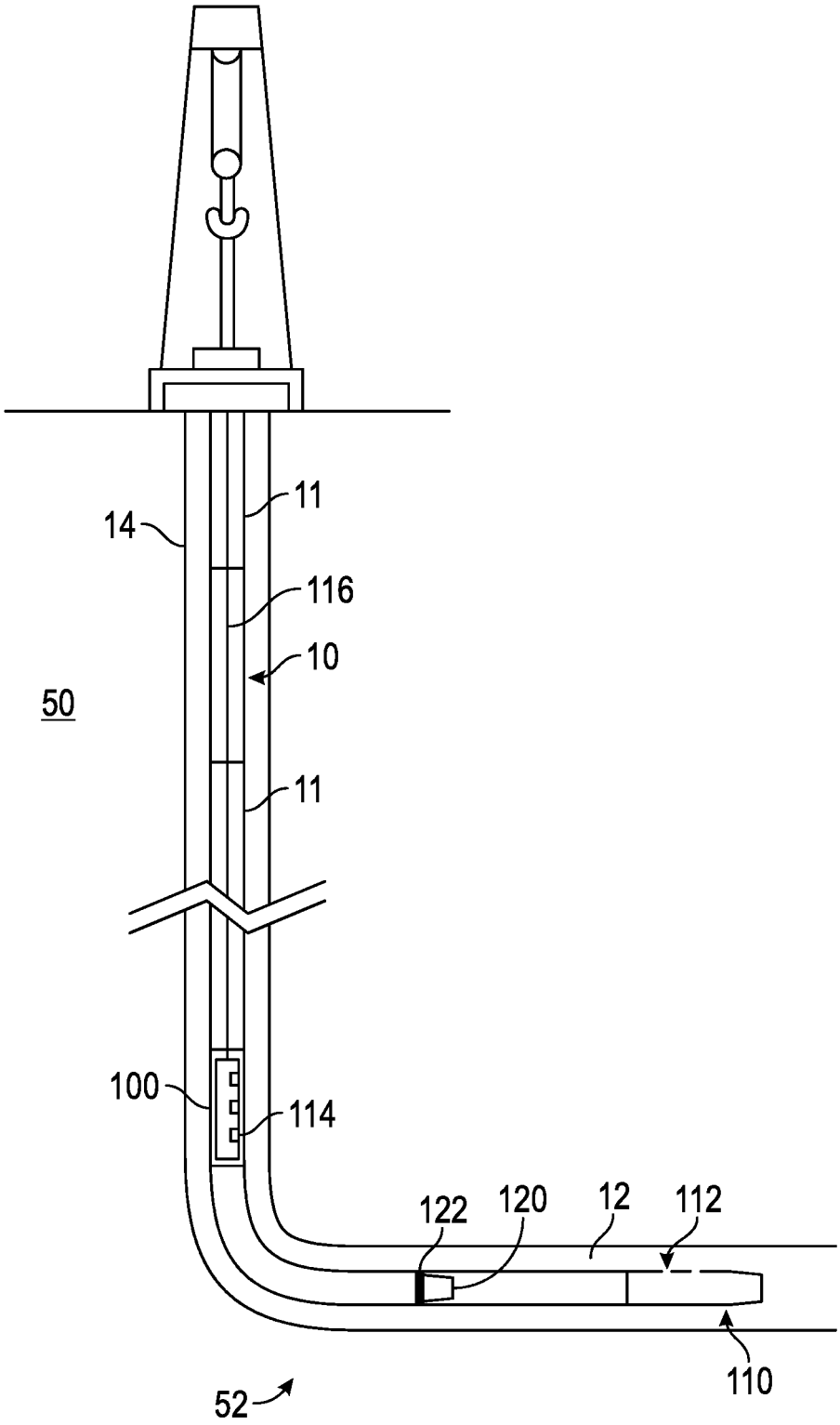
FIG. 2 is a schematic diagram of an example of removing a logging tool on a wireline and seating a float valve in the casing in accordance with various aspects of the present disclosure.

FIG. 2 illustrates a logging while casing retrieval process according to at least one instance of the present disclosure. After the logging tool 100 has passed through the predetermined portion 52 of the subterranean formation 50 and/or after completion of the casing run, a conveyance 116 can be run through the casing string 10 to retrieve the logging tool 100 back to surface. Example conveyances 116 include wireline and coiled tubing, selectable in dependence upon the configuration of the wellbore.

While FIGS. 1 and 2 illustrate a wellbore having a single vertical portion followed by a substantially horizontal portion, it is within the scope of this disclosure to implement the casing string 11 and/or the logging tool 100 within a wellbore 14 having any number of vertical portions and/or horizontal portions, or any deviations therebetween. In instances in which the retrieval conveyance 116 is wire-based, deployment downhole to the logging tool can require what is commonly referred to as a wireline tractor conveyance utilized to pull the bottom end of the wireline across non-vertical portions of the casing string to the logging tool.

Referring back to FIG. 2, the conveyance 116, shown as wireline, can be operably received within casing string 10 and can travel downhole to the distal end 12 of casing string 10 where the logging tool 100 is attached. The conveyance 116 can operably decouple the connection device 150 that couples the logging tool 100 with the casing string 10 while simultaneously and/or nearly simultaneously achieving a coupling of the conveyance 116 to the logging tool 100. The conveyance 116 can be operable to generate an actuation force that actuates the connection device 150 to disconnect the logging tool 100 from the casing string 10. In at least one instance, the actuation force is a pulling force applied by the now-attached wireline conveyance 116 upon the connection device 150 on the order of 2,000 pounds or less.

The logging tool 100 has an outer diameter sufficiently small to pass through the inner bore of the casing string 10 after being decoupled from the casing string 10. In at least one example, the maximum outer diameter of the logging tool 100 is at least about half an inch less than the minimum inner diameter of the casing string 10.

In at least one instance, after the logging tool 100 has passed through the predetermined portion or zone of interest 52 of the casing string 10, the logging tool 100 can return to the low power or standby mode. In other instances, the logging tool 100 can transition back and/or maintain full power mode upon coupling with the conveyance 116 and be electrically coupled for power and/or data communication by the conveyance 116. The logging tool 100 can have data stored therein associated with the zone of interest 52 of the subterranean formation. In at least one instance, the logging tool 100 can transfer data through one or more wired and/or wireless electrical couplings with the conveyance 116. In other instances, the logging tool 100 can store the data until return to surface for download and/or review.

After retrieval of the logging tool 100, the casing operation can continue including, but not limited to, running more casing segments into the wellbore and/or cementing the casing into the wellbore.

Figure 3:
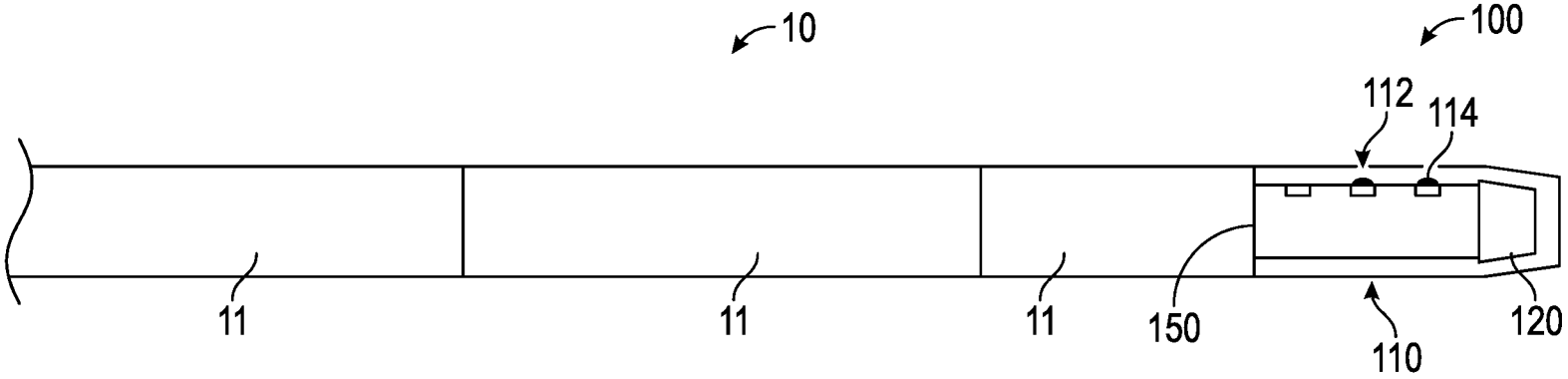
FIG. 3 is a schematic diagram detailing a logging tool located within a protective sheath at a distal end of a casing string in accordance with various aspects of the present disclosure.

As can be appreciated in FIGS. 1 and 3, one or more float valves 120 can be releasably coupled with a lower, distal end of the logging tool 100. As background, float valves, acting as one-way check valves, permit fluid, including cement, to flow out of the casing string but resist or preclude ingress of liquids into the casing string through the float valve. By preventing fluid from filing the casing string as the string is being deployed into the wellbore, the casing string will have a "floating" force that advantageously decreases the weight of the casing string that must be supported at the surface. Moreover, during the cementing process, the float valve permits pumped cement to flow out of the casing string into the annulus, but prevents the cement from back-flowing into the string.

FIG. 2 depicts a float valve 120 and a corresponding profile 122 formed at an inner surface of the casing string 10 and with which the float valve 120 engages. The float valve 120 couples to the casing string 10 in the profile 122 and then decouples from logging tool 100, exemplarily in a uniform upward motion of the logging tool as it is retrieved up the casing string 10. Profiles 122 can be formed in one or more casing segments 11 within a casing string 10 and/or at junctures between casing segments 11.

It is also within the scope of this disclosure to utilize any number of float valves 120 and/or corresponding profiles 122 in dependence upon the specific well completion plan. The engagement of the float valve 120 to the profile 122 can operate to decouple the float valve 120 from the logging tool 100.

The logging tool 100 can include a protective sheath 110 thereabout that protects the logging tool 100 from wellbore conditions and/or impacts with obstacles, including the wellbore walls, during deployment of the casing 10 and logging tool 100 together, into the wellbore 14. The protective sheath 110 can be coupled to a lower end of the first pipe element 11 of the casing string 116 and is configured to receive the logging tool 100 therein. In at least one configuration, the connection of the protective sheath 110 to the casing string 116 includes abutting shoulders capable of withstanding 20,000 pound compressive forces therebetween. It is also contemplated that the protective sheath 110 can be releasably coupled to the logging tool 100. In at least one configuration, the protective sheath 110 latches to the logging tool 100.

The protective sheath 110 can include one or more ports, apertures, and/or windows 112 that permit the logging tool 100 to conduct logging operations therethrough. The one or more ports, apertures, and/or windows 112 can further allow one or more sensors 114 to determine position and/or location of the logging tool 100 within the wellbore 14. The sensors 114 can actuate the logging tool 100 to transition between a standby power mode and an operating power mode.

Figure 4:
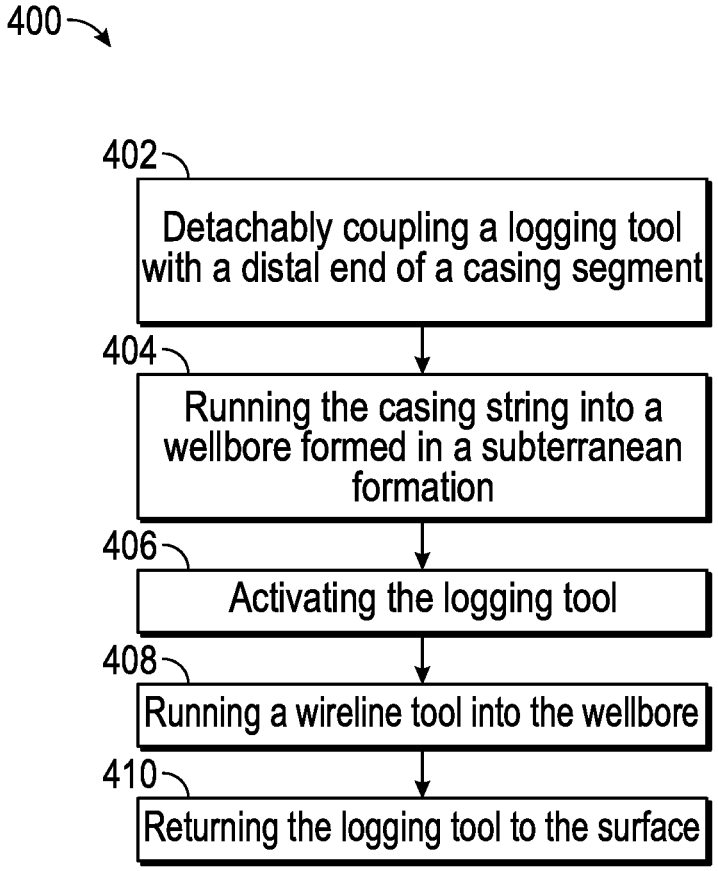
FIG. 4 is a flow chart of a method for logging a wellbore using a logging tool, coupled to a casing string that is run into the wellbore, and then subsequently removing the logging tool using wireline in accordance with various aspects of the present disclosure.

FIG. 4 illustrates a flowchart of a method for use of a logging tool couplable with a casing string according to at least one instance of the present disclosure. The method 400 can be implemented with respect to the apparatus and/or systems described with respect to in FIGS. 1-3, and while specific processes are described below, no specific order is intended and/or implied. Further, additional processes, sub-processes, and/or methods can be implemented within method 400 without deviating from this disclosure. The method can begin at block 402.

At block 402, a logging tool can be detachably coupled with a distal end of a casing segment. The casing segment can be one segment coupled with and/or couplable to additional casing segments, thereby forming a casing string. The logging tool can be coupled with the distal end of the casing segment forming the distal end of the casing string. The logging tool can be coupled with the appropriate casing segment prior to coupling the casing segment with adjacent casing segments, thereby forming the casing string. In other instances, the logging tool can be coupled with the appropriate casing segment after coupling the casing segment with adjacent casing segments, thereby forming the casing string. After coupling the logging tool with the casing segment and/or casing string, the method 400 can proceed to block 404.

At block 404, the casing string can be run into a wellbore formed within a subterranean formation and in which the casing string has a logging tool detachably coupled with the distal end thereof. After running the casing string at least partially within the wellbore, the method 400 can proceed to block 406.

At block 406, the logging tool can be activated upon reaching a predetermined location within the wellbore formed in the subterranean formation. Upon activation, the logging tool can obtain data related to the wellbore. Activation of the logging tool can be by transitioning the logging tool from a standby/low power mode to a full power, operational mode. The activation can occur after a predetermined period of time, at a predetermined pressure, a predetermined temperature, a predetermined depth, predetermined inclination, and/or based on any sensor information obtained by the logging tool. Upon activation, the logging tool can take one or more measurements of the formation as the casing continues to be run in hole. After completion of the logging and/or casing operation, the method 400 can proceed to block 408.

At block 408, a wireline can be run into the wellbore. The wireline can engage with the logging tool disposed at the distal (e.g. downhole) end of the casing string. The wireline can be operable to decouple the logging tool from the casing string. In at least one instance, the logging tool can be transitioned from a full power mode to a standby power mode upon decoupling from the casing string. In at least one instance, the logging tool can be decoupled from the casing string by a pull force (e.g. uphole) of approximately 2,000 pounds or less. After decoupling of the logging tool from the casing string, the method 400 can proceed to block 310.

At block 410, the logging tool can be returned to surface. After the logging tool is returned to the surface, the formation measurements stored in memory can be retrieved and used for optimizing future well operations.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

STATEMENT OF THE CLAIMS

Statement 1: A system comprising a casing string having one or more casing segments, the casing string having a lower distal end and an upper proximal end in an installed configuration within a wellbore; a logging tool detachably coupled to the casing string at the distal end thereof, wherein the logging tool and casing string are configured to be deployed into the wellbore, coupled together; and wherein the logging tool is configured to log formation data during at least a portion of deployment of the logging tool and casing string into the wellbore.

Statement 2: The system of Statement 1, further comprising at least one float valve coupled to a distal end of the logging tool.

Statement 3: The system of Statement 1 or Statement 2, wherein the float valve is operable to engage and couple with a profile in an interior surface of the casing string as the logging tool is being retrieved from the wellbore.

Statement 4: The system of any one of Statements 1 through 3, wherein the float valve is separable from the logging tool.

Statement 5: The system of any one of Statements 1 through 4, further comprising a battery power source powering the logging tool.

Statement 6: The system of any one of Statements 1 through 5, wherein the logging tool is transitionable from a standby power mode to a full power mode in dependence upon the logging tool's position within the wellbore.

Statement 7: The system of any one of Statements 1 through 6, further comprising a protective sheath positioned about at least a portion of the logging tool.

Statement 8: The system of any one of Statements 1 through 7, wherein the casing string has a minimum inner diameter at least about one and a quarter centimeter (about 1.25 cm) greater than a maximum outer diameter of the logging tool.

Statement 9: A logging tool deployable into a wellbore coupled to a casing string, the logging tool comprising a logging tool detachably couplable with a distal end of a casing string, wherein the casing string has a lower distal end and an upper proximal end; a battery power source operably coupled with the logging tool, the battery power source having a standby mode and a full power mode; the logging tool having a maximum outer diameter less than a minimum inner diameter of the casing string, thereby permitting the logging tool to pass through the casing string for removal therefrom; and wherein the battery power source is operable to transition from the standby mode to the full power mode upon detection of a predetermined condition.

Statement 10: The logging tool of Statement 9, wherein the battery power source transitions the logging tool from the standby power mode to the full power mode upon placement within a predetermined portion of a wellbore.

Statement 11: The logging tool of Statement 9 or Statement 10, wherein the logging tool further comprises a protective sheath disposed over at least a portion thereof.

Statement 12: The logging tool of any one of Statements 9 through 11, wherein the logging tool has an outer diameter at least about one and a quarter centimeter (about 1.25 cm) less than the inner diameter of the casing string.

Statement 13: The logging tool of any one of Statements 9 through 12, further comprising at least one float valve coupled to a distal end of the logging tool.

Statement 14: The logging tool of any one of Statements 9 through 13, wherein the float valve is operable to engage and couple with a profile in an interior surface of the casing string as the logging tool is being retrieved from the wellbore and the float valve is separable from the logging tool.

Statement 15: A method comprising: running a casing string into a wellbore, the casing string has a lower distal end and an upper proximal end and having a logging tool detachably coupled to the distal end thereof; and activating the logging tool to obtain data relating to the wellbore formed in a subterranean formation.

Statement 16: The method of Statement 15, further comprising transitioning the logging tool from a standby power mode to a full power mode upon placement of the logging tool within a predetermined portion of the wellbore.

Statement 17. The method of Statement 15 or Statement 16, further comprising running a wireline into the wellbore, the wireline operable to decouple the logging tool from the casing string; decoupling the logging tool from the casing string; and returning the logging tool to surface.

Statement 18: The method of any one of Statements 15 through 17, wherein decoupling the logging tool from the casing string is application of a longitudinal, uphole force to an uphole end of the logging tool.

Statement 19: The method of any one of Statements 15 through 18, wherein the logging tool has one or more float valves coupled to a distal end thereof.

Statement 20: The method of any one of Statements 15 through 19, wherein the logging tool has an outer diameter at least about one and a quarter centimeter (about 1.25 cm) less than an inner diameter of the casing string.

What is claimed is:

1. A system comprising:

a casing string having one or more casing segments, the casing string having a lower distal end and an upper proximal end in an installed configuration within a wellbore;

a logging tool detachably coupled to the casing string at the distal end thereof, wherein the logging tool and casing string are configured to be deployed into the wellbore, coupled together; and at least one float valve coupled to a distal end of the logging tool, wherein the logging tool is configured to log formation data during at least a portion of deployment of the logging tool and casing string into the wellbore.

2. The system of claim 1, wherein the float valve is operable to engage and couple with a profile in an interior surface of the casing string as the logging tool is being retrieved from the wellbore.

3. The system of claim 1, wherein the float valve is separable from the logging tool.

4. The system of claim 1, further comprising a battery power source powering the logging tool.

5. The system of claim 1, wherein the logging tool is transitionable from a standby power mode to a full power mode in dependence upon the logging tool's position within the wellbore.

6. The system of claim 1, further comprising a protective sheath positioned about at least a portion of the logging tool.

7. The system of claim 1, wherein the casing string has a minimum inner diameter at least about one and a quarter centimeter (about 1.25 cm) greater than a maximum outer diameter of the logging tool.

8. A logging tool deployable into a wellbore coupled to a casing string, the casing string having a lower distal end and an upper proximal end, the logging tool being detachably couplable with the lower distal end of the casing string, the logging tool comprising:

a battery power source operably coupled with the logging tool, the battery power source having a standby mode and a full power mode;

wherein the logging tool has a maximum outer diameter less than a minimum inner diameter of the casing string, thereby permitting the logging tool to pass through the casing string for removal therefrom;

wherein at least one float valve is coupled to a distal end of the logging tool; and wherein the battery power source is operable to transition from the standby mode to the full power mode upon detection of a predetermined condition.

9. The logging tool of claim 8, wherein the battery power source transitions the logging tool from the standby power mode to the full power mode upon placement within a predetermined portion of a wellbore.

10. The logging tool of claim 8, wherein the logging tool further comprises a protective sheath disposed over at least a portion thereof.

11. The logging tool of claim 8, wherein the logging tool has an outer diameter at least about one and a quarter centimeter (about 1.25 cm) less than the inner diameter of the casing string.

12. The logging tool of claim 8, wherein the float valve is operable to engage and couple with a profile in an interior surface of the casing string as the logging tool is being retrieved from the wellbore and the float valve is separable from the logging tool.

13. A method comprising:

running a casing string into a wellbore, the casing string has a lower distal end and an upper proximal end and having a logging tool detachably coupled to the distal end thereof; and activating the logging tool to obtain data relating to the wellbore formed in a subterranean formation, wherein the logging tool has one or more float valves coupled to a distal end thereof.

14. The method of claim 13, further comprising transitioning the logging tool from a standby power mode to a full power mode upon placement of the logging tool within a predetermined portion of the wellbore.

15. The method of claim 13, further comprising running a wireline into the wellbore, the wireline operable to decouple the logging tool from the casing string;

decoupling the logging tool from the casing string; and returning the logging tool to surface.

16. The method of claim 13, wherein decoupling the logging tool from the casing string is application of a longitudinal, uphole force to an uphole end of the logging tool.

17. The method of claim 13, wherein the logging tool has an outer diameter at least about one and a quarter centimeter (about 1.25 cm) less than an inner diameter of the casing string.

* * * * *